United States Patent [19]

Yagyu et al.

[11] Patent Number: 4,504,185

[45] Date of Patent: Mar. 12, 1985

[54] HYDRAULIC CIRCUIT OF HYDRAULIC POWER SHOVEL

[75] Inventors: Takashi Yagyu, Ibaraki; Takeshi Yamaguchi, Tsuchiura; Sotaro Tanaka; Yasuo Sakaki, both of Ibaraki, Japan

[73] Assignee: Hitachi Construction Machinery Co., Inc., Tokyo, Japan

[21] Appl. No.: 407,630

[22] Filed: Aug. 12, 1982

[30] Foreign Application Priority Data

Aug. 18, 1981 [JP] Japan ..... 56-128244
Aug. 26, 1981 [JP] Japan ..... 56-132601

[51] Int. Cl.[3] ..... E02F 3/86
[52] U.S. Cl. ..... 414/700; 414/708
[58] Field of Search ..... 414/699, 700, 708, 712; 91/536, 534

[56] References Cited

U.S. PATENT DOCUMENTS 3,705,631 12/1972 Seaberg ..... 91/536 X
3,927,781 12/1975 Okabe ..... 414/700
3,952,896 4/1976 Hayward ..... 414/700 X

*Primary Examiner*—Robert J. Spar
*Assistant Examiner*—Donald W. Underwood
*Attorney, Agent, or Firm*—Antonelli, Terry & Wands

[57] ABSTRACT

A hydraulic circuit for a hydraulic power shovel of the type having a swingable boom, swingable arm and a bucket attached to the end of the arm. The hydraulic circuit includes a levelling cylinder adapted to extend and contract in response to the swinging of the arm, and a switching valve device movable between a first position where it provides a communication between the levelling cylinder and a boom cylinder and a second position where it provides a communication between the levelling cylinder and an arm cylinder. When the switching valve device takes the first position, the levelling cylinder is communicated with the boom cylinder so that the boom is swung downwardly in response to the upward swinging of the arm, thereby to move the bucket horizontally. On the other hand, when the switching valve device takes the second position, the levelling cylinder and the boom cylinder are disconnected hydraulically so that the arm is allowed to swing independently of the boom.

9 Claims, 5 Drawing Figures

HYDRAULIC CIRCUIT OF HYDRAULIC POWER SHOVEL

BACKGROUND OF THE INVENTION

The present invention relates to a hydraulic power shovel such as loading shovel or a back hoe shovel, equipped with a swingable boom, an arm pivotally connected to the boom and a bucket held by the arm, wherein particularly, the invention is concerned with a hydraulic power shovel provided with an automatic horizontal driving system for horizontally driving the bucket.

In digging operation in a loading shovel, it is necessary to drive the bucket horizontally and forwardly by swinging the arm upwardly while swinging the boom downwardly. It is, however, extremely difficult to simultaneously manipulate both of the arm cylinder for driving the arm and the boom cylinder for driving the boom.

In order to eliminate this difficulty, in, for example, U.S. Pat. No. 3,927,781, an automatic horizontal driving system has been developed in which the boom is automatically driven pivotally in response to the pivotal movement of the arm so that the bucket moves horizontally solely through the manipulation of the arm cylinder.

This known horizontal driving system is constituted by a levelling cylinder adapted to extend and contract in accordance with the movement of the arm, and a hydraulic circuit for hydraulically connecting the levelling cylinder to the boom cylinder for driving the boom.

In operation, after positioning the arm such that the bucket attached to the end thereof contacts the ground, the arm is pivotally moved forwardly. This pivotal movement of the arm causes the levelling cylinder to extend so that the working oil in the rod-side chamber in the levelling cylinder is delivered to the rod-side chamber of the boom cylinder and the working oil in the bottom-side chamber of the boom cylinder is drawn into the bottom-side chamber of the levelling cylinder to retract the boom cylinder to thereby swing the boom downwardly. Consequently, the bucket is driven horizontally and forwardly along the ground surface to perform the digging operation. This known horizontal driving system, however, has encountered problems or drawbacks due to the fact that the levelling cylinder is continuously held in fluid connection with the boom cylinder, as will be realized from the following description.

One cycle of loading operation includes the steps of conducting the digging by pushing the bucket horizontally and forwardly through forward swinging of the arm, swinging the boom upwardly to raise the bucket to release the soil and sand from the bucket to the bed of a dump truck, swinging the arm downwardly and then swinging the boom downwardly to return the bucket to the starting position. When the arm is swung downwardly, the working oil is forced out from the levelling cylinder into the boom cylinder, so that the boom is swung upwardly. Consequently, the required downward stroke of swinging of the boom is undesirably increased. When the arm is swung downwardly while the boom has been swung to the upper limit position, the boom cylinder cannot extend further even though the working oil is forcibly delivered from the bottom-side chamber of the levelling cylinder to the bottom-side chamber of the boom cylinder. Consequently, the working oil is confined in the levelling cylinder so that the oil pressure is increased in the bottom-side chambers of the levelling cylinder and the boom cylinder. As this oil pressure is increased to the set pressure of a relief valve connected to the bottom-side chamber of the boom cylinder, the relief valve is opened to release the oil from the bottom-side chamber of the levelling cylinder, so that the levelling cylinder is allowed to contract to permit the arm to be swung downwardly. In such a case, therefore, an impractically large energy is required for contracting the levelling cylinder, i.e. for swinging the arm downwardly.

In some sites, it is required to move the bucket along an arcuate path from the lower side to the upper side insteadly of pushing the bucket forwardly and horizontally. The conventional horizontal driving system, however, cannot cope with such a demand.

SUMMARY OF THE INVENTION

Accordingly, it is a primary object of the invention to provide a hydraulic circuit of power shovel having a novel horizontal driving system which makes it possible, on the one hand, to swing the boom in response to the swinging of the arm to drive a bucket attached to the arm substantially horizontally and,. on the other hand, to prevent the boom from responding to the swinging of the arm.

To this end, according to the invention, there is provided a hydraulic circuit of a hydraulic power shovel of the type having a boom pivotally carried by a chassis and an arm pivotally connected to the boom, with the hydraulic circuit comprising: a boom cylinder having a rod-side chamber and a bottom-side chamber and adapted to drive the boom; an arm cylinder having a bottom-side chamber and a rod-side chamber and adapted to actuate the arm pivotally with respect to the boom; a levelling cylinder connected to the arm and having a rod-side chamber and a bottom-side chamber; a first conduit for providing a communication between the rod-side chamber of the levelling cylinder and the rod-side chamber of the boom cylinder; a second conduit for providing a communication between the bottom-side chamber of the levelling cylinder and the bottom-side chamber of the boom cylinder; and a control circuit for supplying and discharging working oil to and from the boom cylinder and the arm cylinder. A switching is provided which is capable of closing the first conduit and the second conduit and, at the same time, hydraulically connecting the levelling cylinder to a reservoir through a working oil supply and discharge means.

According to one form of the invention, the switching device includes a control valve means movable between a first position for communicating the levelling cylinder with the boom cylinder and a second position for communicating the levelling cylinder with the working oil supply and discharge means, and an actuator means for actuating the control valve means. The actuator means is adapted to move the control valve means to the second position in response to the manipulation of the arm cylinder in the retracting direction. Therefore, during the operation of the arm cylinder in the extending direction, the horizontal driving system operates to cause a horizontal movement of the bucket whereas, when the arm cylinder is driven in the retracting direction, the horizontal driving system is inoperative to solely rotate the arm.

According to another form of the invention, there is provided an actuator means for manual operation of the control valve means. It is, therefore, possible to make the horizontal driving system inoperative regardless of the direction of movement of the arm cylinder to allow the bucket to move along an arcuate path.

Other objects and features of the invention will become clear from the following description of the preferred embodiments of the invention taken in conjunction with the accompanying drawings.

DESCRIPTION OF THE PREFERRED EMBODIMENTS

Figure 1:
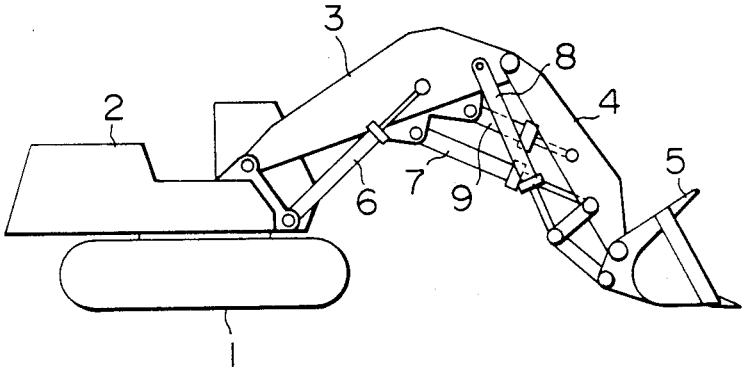
FIG. 1 is a side elevational view of a loading shovel to which the present invention is applied.

Referring now to the drawings wherein like reference numerals are used throughout the various views to designate like parts and, more particularly to FIG. 1, according to this figure, a loading shovel has a lower running unit 1 and an upper turret unit 2, with the upper turret unit 2 swingably carrying a boom 3 which in turn swingably supports an arm 4. A bucket 5 is pivotally secured to an end of the arm 4, with a boom cylinder 6, for swinging the boom 3, being connected to the boom 3. The arm 4 is adapted to be swung relative to the boom 3 by an arm cylinder 7 connected to the arm 4. A bucket cylinder 8, connected to the bucket 5, is adapted to swing the bucket 5 with respect to the arm 4. In addition to these cylinders, a levelling cylinder 9, adapted to extend and contract in response to the swinging of the arm 4, is connected to the arm 4. These cylinders are adapted to be controlled by the hydraulic circuit which will be explained later.

Figure 2:
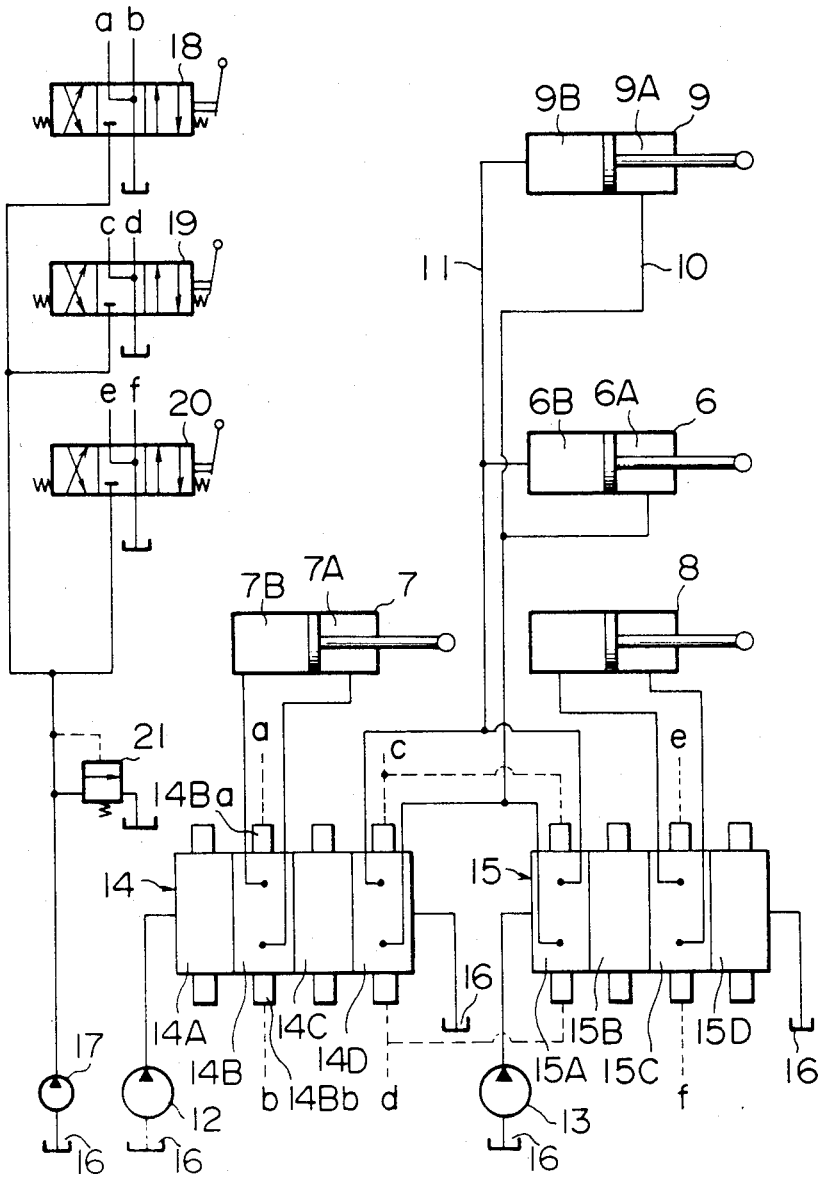
FIG. 2 PRIOR ART
FIG. 2 is a hydraulic circuit diagram of a conventional loading shovel.

As shown in FIG. 2, in a typical conventional hydraulic circuit, the rod-side chamber 9A of a levelling cylinder 9 is communicated with the rod-side chamber 6A of a boom cylinder 6 through a conduit 10. The bottom-side hydraulic chamber 9B of the levelling cylinder 9 is communicated with the bottom-side chamber 6B of the boom cylinder 6 through a conduit 11. The supply of the pressurized oil to the boom cylinder 6, arm cylinder 7, bucket cylinder 8 and other actuators (not shown) is performed through a control circuit which includes main pumps 12, 13, directional control valve groups 14 and 15 and a reservoir or tank 16. The directional control valve groups 14 and 15 respectively have pilot operated directional control valves 14A to 14D and 15A to 15D, with the directional control valve 14B being a two position valve. When the pilot presure is supplied to the pilot pressure receiving section 14B*b*, the valve 14B takes a first position where the pressurized oil from the main pump 12 is delivered to the rod-side chamber 7A of the arm cylinder 7, while the oil from the bottom-side chamber 7B is returned to the tank 16. To the contrary, when another pilot pressure receiving section 14B*a* receives the pilot pressure, the directional control valve 14B is switched to the second position where it permits the presurized oil from the main pump 12 to be delivered to the bottom-side chamber 7B of the arm cylinder while returning the oil from the rod-side chamber 7A to the tank 16. Other directional control valves have identical construction to the directional control valve 14B so that the detailed description of such valves is omitted.

The control circuit is further provided with a pilot circuit which supplies the pilot pressure to the directional control valves. The pilot circuit includes a pilot pump 17, pilot valve 18 for arm, pilot valve 19 for boom, pilot valve 20 for bucket and a relief valve 21. The output ports of the arm pilot valve 18 are connected to the pressure receiving sections of the directional control valve 14B for arm, through pilot conduits a and b, respectively. The output ports of the boom pilot valve 19 are respectively connected to the pressure receiving sections of the directional control valves 14D, 15A for boom, through pilot conduits c and d. The output ports of the bucket pilot valve 20 are respectively connected to the pressure receiving section of the directional control valve 15C for the bucket through pilot conduits e and f.

In operation, as the arm pilot valve 18 operates to send a pilot pressure signal to the directional control valve 14B through the pilot conduit a, the pressurized oil from the main pump 12 is supplied to the bottom-side chamber 7B of the arm cylinder 7 through the directional control valve 14B, so that the rod of the arm cylinder 7 is extended to swing the arm 4 forwardly. As a result of the forward swinging of the arm 4, the rod of the levelling cylinder 9 is extracted so that the volume of the rod-side chamber 9A is reduced to displace the oil therefrom to the rod-side chamber 6A of the boom cylinder 6. Consequently, the rod of the boom cylinder 6 is contracted to lower the boom 3. Thus, the bucket 5 is moved along the ground surface solely by the manipulation of the arm pilot valve 18.

However, in the conventional hydraulic circuit shown in FIG. 2, since the levelling cylinder 9 and the boom cylinder 6 are always communicated with each other through the conduits 10 and 11, it is not possible to independently swing the arm 4.

Figure 3:
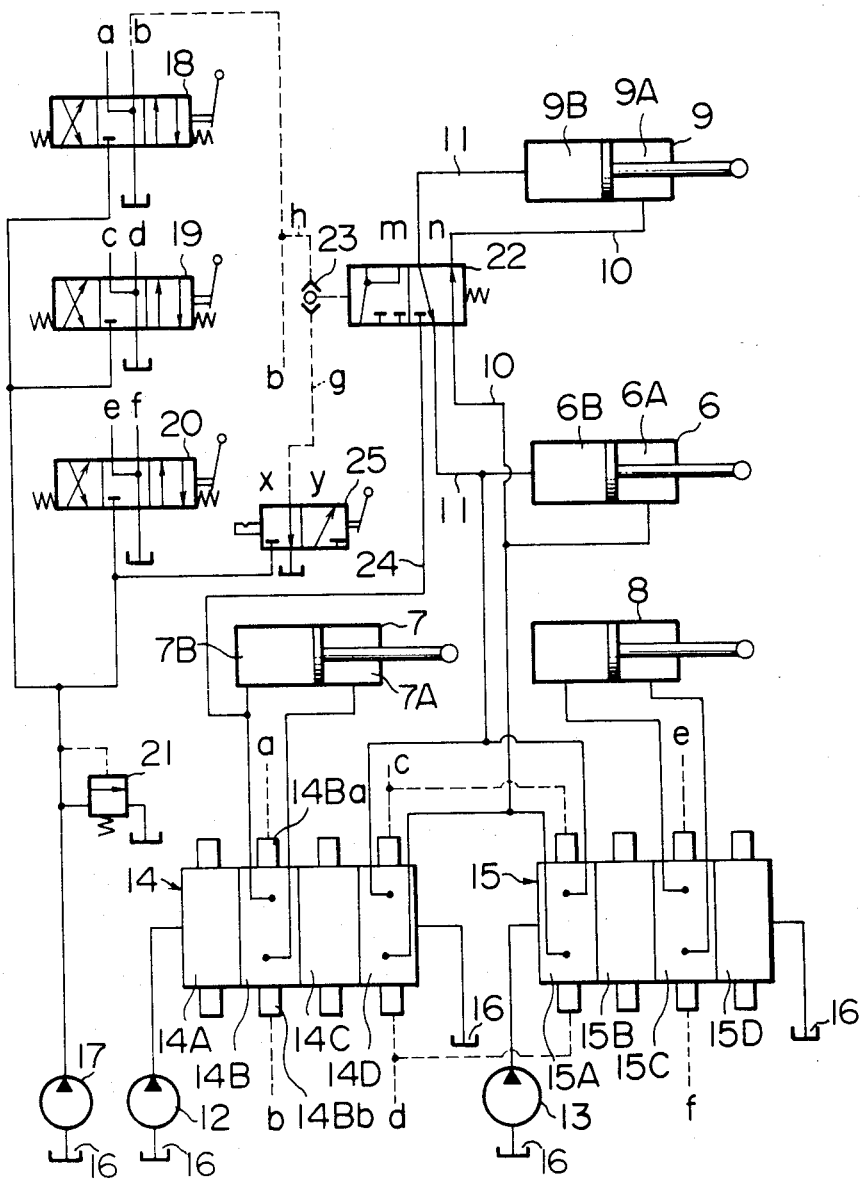
FIG. 3 is a hydraulic circuit diagram in accordance with an embodiment of the invention.

As shown in FIG. 3, a switching valve 22 is disposed at an intermediate portion of the conduits 10 and 11 connected between the rod-side chambers 9A and 6A and the bottom-side chambers 9B and 6B of the levelling cylinder 9 and the boom cylinder 6, respectively.

The switching valve 22 is a spring biased, pilot operated directional control valve having two positions m,n, and is normally held at the position n. When taking the normal position n, the switching valve 22 opens the conduits 10 and 11 while, when taking the position m, the switching valve 22 closes the conduits 10, 11 and permits the rod-side chamber 9A and the bottom-side chamber 9B of the levelling cylinder 9 to be communicated with the bottom-side chamber 7B through portions of the conduits 10, 11 and a conduit 24.

The pilot pressure receiving section of the switching valve 22 is connected to the output port of a shuttle valve 23 having two input ports one of which is connected through a conduit h to the pilot conduit b leading from the pilot valve 18 while the other is connected to a manual pilot valve 25 through a conduit g. Thus, the pilot pressure in either one of the conduits g and h is delivered to the switching valve 22 to shift the same to the position m. The manual pilot valve 25 is provided for selecting one out of two operation modes, namely, a horizontal movement of the bucket and the movement of the same along an arcuate path. When the horizontal movement is selected, the valve 25 takes a position x where no pilot pressure signal is generated in the conduit g. When the arcuate movement of the bucket is selected, the valve 25 takes a position y to permit the generation of the pilot pressure signal in the conduit g.

Referring first to the horizontal forward driving of the bucket 5, the manual pilot valve 25 is initially held at the position x so that no pilot pressure exists in the conduit g. Then, the arm pilot valve 18 is operated to produce a pilot pressure signal in the pilot conduit a. This pilot pressure signal operates the directional control valve 14B to permit the pressurized oil from the main pump 12 to be delivered to the bottom-side chamber 7B of the arm cylinder 7. Consequently, the rod in the arm cylinder 7 is extended to swing the arm 4 forwardly. Since in this state both of the pilot pressure conduits b and g lack the pilot pressure signal, the switching valve 22 is held at the normal position n as illustrated so that the levelling cylinder 9 is communicated with the boom cylinder 6 through the conduits 10 and 11. The rod of the levelling cylinder 9 extends as a result of the forward swinging of the arm 4, so that the pressure produced in the rod-side chamber 9A is transmitted to the rod-side chamber 6A of the boom cylinder 6 to lower the boom 3. Thus, the boom 3 is lowered to compensate for the rise of the end of the arm 4, so that the end of the arm 4, i.e. the bucket 5, is moved horizontally.

Subsequently, the boom is swung upwardly to release the soil and/or sand from the bucket 5 to a dump truck and then the arm 3 is swung downwardly, by the following operation of the hydraulic circuit. The arm pilot valve 18 is operated to produce pilot pressure signal in the pilot conduit b. This pilot pressure signal actuates the directional control valve 14B to permit the pressurized oil from the main pump 12 to be delivered to the rod-side chamber 7A of the arm cylinder 7. As a result, the rod of the arm cylinder 7 is retracted to swing the arm 4 downwardly or rearwardly. Simultaneously, the pilot pressure signal in the pilot conduit b acts to shift the switching valve 22 to the position m, so that the conduits 10 and 11 are closed and the rod-side chamber 9A and the bottom-side chamber 9B of the levelling cylinder 9 is brought to be communicated with the bottom-side chamber 7B of the arm cylinder 7 through portions of the conduits 10, 11, switching valve 22 in the position m and then through the conduit 24. Consequently, though the levelling cylinder 9 is retracted in response to the downward swinging of the arm 4, oil displaced from the bottom-side chamber 9B is not delivered at all to the boom cylinder 6 but is delivered partially to the rod-side chamber 9A and remainder of the displaced oil is released to the tank 16 through the directional control valve 14B. Thus, when the rod of the arm cylinder 7 is retracted, the levelling cylinder 9 is automatically disconnected hydraulically from the boom cylinder 6 so that the latter is not operated at all. For the same reason, it is possible to rearwardly retract the arm 4 even when the rod of the boom cylinder 6 is in the fully extended position.

For selecting the bucket movement along the arcuate path, the manual pilot valve 25 is shifted to the position y. By so doing, a pilot pressure signal is generated in the pilot conduit g and is delivered to the pressure receiving section of the switching valve 22 through the shuttle valve 23 to shift the switching valve 22 to the position m. Therefore, the levelling cylinder 9 is hydraulically disconnected from the boom cylinder 6 even when the rod of the arm cylinder 7 is extended, so that the boom cylinder 6 does not operate at all. Then, the pressurized oil from the main pump 12 is delivered to the bottom-side chamber 7B of the arm cylinder 7, so that the arm 4 is swung forwardly to cause an upward movement of the bucket 5 along the arcuate path. Meanwhile, the levelling cylinder 9 extends its rod in response to the forward swinging of the arm 4 so that the volume of the bottom-side chamber 9B of the levelling cylinder 9 is increased to require an additional supply of the oil. In this embodiment, this additional supply of oil is made from the bottom-side chamber 7B of the arm cylinder 7 held at an elevated pressure, so that the undesirable generation of vacuum in the bottom-side chamber 9B is avoided.

The switching valve 22 of the embodiment shown in FIG. 3 are normally held in the position n and are shifted to the position m upon receipt of a pilot pressure signal instructing the contraction of the arm cylinder 7 or the pilot pressure signal instructing the arcuate movement of the bucket 5. This valve, however, may be modified to normally take the position m and to shift to the position n upon receipt of the pilot pressure instructing the extension of the rod of the arm cylinder 7 or the pilot signal which instructs the horizontal movement of the bucket 5.

The use of the pilot pressure signal as means for effecting the shift of the switching valve 22 is not exclusive, and the pilot pressure signal can be substituted by mechanical or electric signal. The switching valve 25, which is a manually operated valve in the described embodiment, may be an automatic valve adapted to automatically change the operation mode from the straight or horizontal digging to the arcuate digging upon detecting the resistance to the bucket 5 during the horizontal digging.

Figure 4:
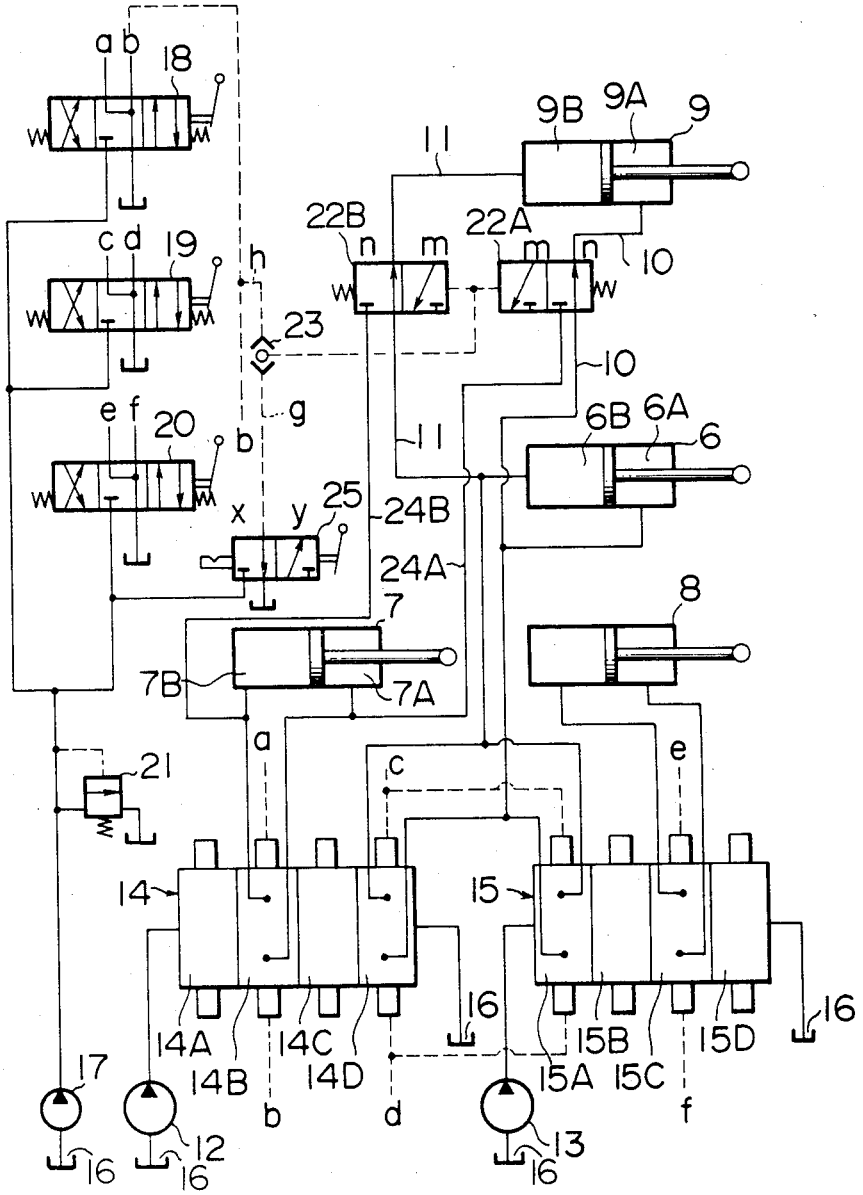
FIGS. 4 and 5 are hydraulic circuit diagrams of other embodiments of the invention, respectively.

In the embodiment of FIG. 4, two switching valves 22A, 22B are used in place of the single switching valve 22 in the embodiment of FIG. 3. The first switching valve 22A is connected in the conduit 10 between the rod-side chamber 9A of the levelling cylinder 9 and the rod-side chamber 6A of the boom cylinder 6, while the second switching valve 22B is disposed at an intermediate portion of the conduit 11 connected between the bottom-side chamber 9B of the levelling cylinder 9 and the bottom-side chamber 6B of the boom cylinder 6. One of the ports of the first switching valve 22A is connected to the rod-side cylinder 7A of the arm cylinder 7 through a conduit 24A, while one port of the second switching valve 22B is connected to the bottom-side chamber 7B of the arm cylinder 7 through a conduit 24B. The switching valves 22A, 22B are spring biased pilot operated valves and are adapted to normally take position x to keep the conduits 10 and 11 open. When these valves 22A, 22B take positions y, these valves close the conduits 10 and 11 and, at the same time, provide communications between the rod-side chamber 9A of the levelling cylinder 9 and the rod-side chamber 7A of the arm cylinder 7 and between the bottom-side chamber 9B of the levelling cylinder 9 and the bottom-side chamber 7B of the arm cylinder 7, respectively, through a part of the conduit 10 and the conduit 24A and through a part of the conduit 11 and a conduit 24B. The switching valves 22A and 22B are adapted to receive a common pilot pressure signal through the shuttle valve 23, so that the switching valves 22A, 22B are operated concurrently. As in the case of the embodiment of FIG. 3, the supply of the pilot pressure signal to the shuttle valve 23 is made from the pilot valves 18 and 25 through conduits h and g.

When the manual pilot valve 25 takes the position x for selecting the horizontal movement of the bucket 5, the bucket is moved horizontally and forwardly as the arm 4 swings forwardly, due to communication between the levelling cylinder 9 and the boom cylinder 6, whereas, when the arm 4 is retracted rearwardly, the communication between the levelling cylinder 9 and the boom cylinder 6 are automatically interrupted to solely permit the swinging of the arm solely 4.

To the contrary, when the manual pilot valve 25 takes the position for selecting the movement of the bucket 5 along the arcuate path, the arm 4 can be swung independently of the boom 3 not only in the rearward swinging but also in the forward swinging of the arm 4, so that the bucket 5 can be moved along the arcuate path. In this embodiment, since the communications are established between the rod-side chambers of the levelling cylinder 9 and the arm cylinder 7 and between the bottom-side chambers of the levelling cylinder 9 and the arm cylinder 7, the levelling cylinder 9 operates to actuate the arm 4 to assist the arm cylinder 4, so that a larger arm actuating power is obtained.

In the embodiments of the invention described hereinbefore, the operation of the switching valve 22 or valves 22A, 22B is made by the pilot pressure signal from the arm pilot valve 18 and by the pilot pressure signal from the manual pilot valve 25. This, however, is not exclusive and the switching valve or valves may be operated solely by the pilot pressure signal from the arm pilot valve 18 or from the manual pilot valve 25. In the embodiments described heretofore, the boom 3 is swung downwardly in response to the forward swinging of the arm 4 to move the bucket 5 horizontally, while, when the arm 4 is swung rearwardly, the boom 3 does not rotate. This, however, is not exclusive and the arrangement may be such that the boom 3 is swung upwardly during rearward swinging of the arm 4 to drive the bucket 5 horizontally rearwardly while, when the arm 4 is swung forwardly, the boom 3 is not swung.

Figure 5:
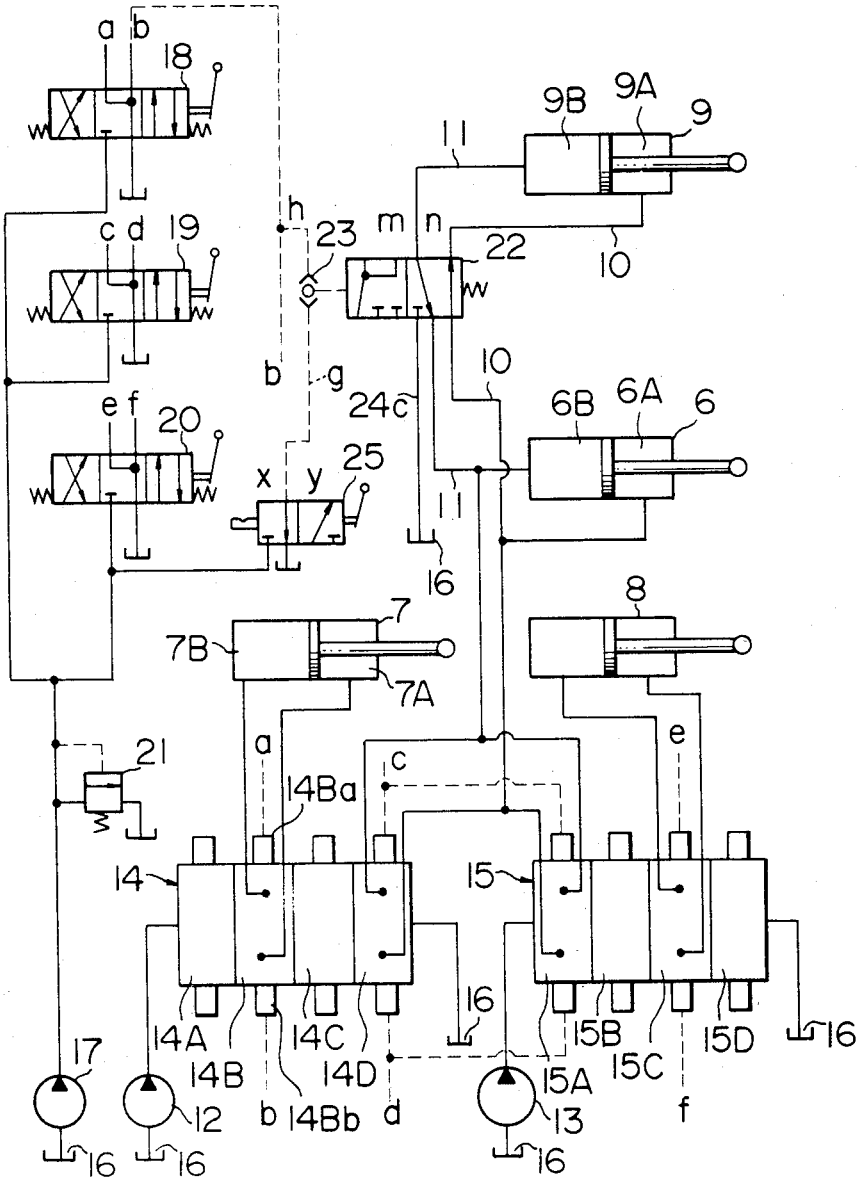

In FIG. 5, the switching valve 22 is directly connected to the tank 16 through a conduit 24C and is not connected to the arm cylinder 7; however, in all other respects, the construction of FIG. 5 corresponds to that of FIG. 3.

As in the case of the embodiment shown in FIG. 3, the levelling cylinder 9 is disconnected from the boom cylinder 6 when the pilot pressure signal is applied on the switching valve 22 through the pilot conduit g or h, to solely permit the swinging of the arm. In the embodiment of FIG. 5, the excess working oil produced in the levelling cylinder 9 during retracting movement of the cylinder 9 is directly discharged to the tank 16, so that the flow resistance offered by the discharged oil is less than that in the embodiment of FIG. 3, where the excess working oil is discharged to the tank 16 through the conduit connected to the arm cylinder 7 and the directional control valve 14B. During extending movement of the levelling cylinder 9, the working oil required is supplied directly from the tank 16, so that the speed of piston of the arm cylinder 7 is faster than that in the embodiment of FIG. 3 where a part of working oil supplied to the arm cylinder 7 is supplied to the levelling cylinder 9. The supply of working oil to the levelling cylinder 9 from the tank 16 can be effected by suction, but it is preferable to apply a suitable pressure on the tank 16 so that the working oil is forced to the levelling cylinder 9 to prevent occurrence of cavitation.

While the invention has been particularly shown and described with reference to the preferred embodiments thereof, it will be understood by those skilled in the art that changes and variations may be made without departing from the spirit or scope of the following claims.

What is claimed is:

1. A hydraulic circuit of a hydraulic power shovel comprising a chassis, a boom pivotally mounted on the chassis, an arm pivotally mounted on said boom, the hydraulic circuit comprising a boom cylinder means pivotally mounted between the chassis and the boom for moving the boom in an upward and downward direction, an arm cylinder means pivotally mounted between said boom and said arm for driving the arm around the connection point between the arm and the boom, a leveling cylinder means pivotally mounted between said arm and said boom for supplying a working medium to the boom cylinder to drive the boom in response to a movement of the arm, a first conduit means for connecting a rod-side chamber of said leveling cylinder means to a rod-side chamber of said boom cylinder means, a second conduit means for connecting a bottom-side chamber of said leveling cylinder means to a bottom-side chamber of said boom cylinder means, a control means for respectively controlling the boom cylinder means and said arm cylinder means, a control valve means disposed in said first conduit and said second conduit, said control valve means being normally disposed in a first position for allowing a communication between said leveling cylinder means and the boom cylinder means, said control valve means being shiftable to a second position for communicating the rod-side chamber and bottom-side chamber of said leveling cylinder means with a working medium supply and discharge means upon receipt of a pilot pressure, and a further conduit connecting the control valve means to the control means for controlling the arm cylinder, said further conduit transmitting the pilot pressure to the control valve means in response to a movement of the arm cylinder in a predetermined direction, said pilot pressure shifting the control valve means to the second position.

2. A hydraulic circuit of a hydraulic power shovel comprising a chassis, a boom pivotally mounted on the chassis, an arm pivotally mounted on said boom, the hydraulic circuit comprising a boom cylinder means pivotally mounted between the chassis and the boom for moving the boom in an upward and downward direction, the boom cylinder means including a rod-side chamber and a bottom-side chamber, an arm cylinder means pivotally mounted between said boom and said arm for driving the arm around a connection point between the arm and the boom, a leveling cylinder means pivotally mounted between said arm and said boom for driving the boom in response to a movement of the arm, said leveling cylinder means including a rod-side chamber and a bottom-side chamber, a first conduit means for providing a communication between said rod-side chamber of said leveling cylinder means and said rod-side chamber of said boom cylinder means, a second conduit means for providing a communication between said bottom-side chamber of said leveling cylinder means and said bottom side chamber of said boom cylinder means, a control circuit means for supplying and discharging the working medium to and from said bottom cylinder means and said arm cylinder means, a switching device for closing said first conduit means and said second conduit means and, at the same time, hydraulically connecting said leveling cylinder means to a reservoir through a working medium supply and discharge means, said switching device including a control valve means disposed at an intermediate postion of said first conduit means and said second conduit means, said control valve means being displaceable between a first position providing a communication between said leveling cylinder means and said boom cylinder means and a second position for providing a communication between said leveling cylinder means and said working medium supply and discharge means, an actuator means for actuating said control valve means, said control valve means includes a pilot operated switching valve normally assuming said first position and being adapted to be shifted to said second position upon receipt of a pilot pressure, and wherein said control circuit means includes a pilot operated directional control valve movable between a first position for supplying the pressureized medium to said rod-side chamber of said arm cylinder means and a second position for supplying the pressurized medium to the bottom-side chamber of said arm cylinder means, a pilot valve means for controlling the supply of the pilot pressure to said pilot operated directional control valve, a first pilot conduit through which a first pilot pressure signal for shifting said pilot operated directional control valve to said first position is transmitted from said pilot valve, and a second pilot conduit through which a second pilot pressure signal for shifting said second pilot operated directional control valve to said second position is transmitted from said pilot valve means, and wherein said actuator has a third pilot conduit for delivering a predetermined one of said first and second pilot pressure signals to said pilot operated switching valve.

3. A hydraulic circuit according to claim 2, wherein said predetermined one of said first and second pilot pressure signals is said second pilot pressure signal.

4. A hydraulic circuit according to claim 3, wherein said actuator further includes an additional pilot conduit means for supplying the pilot pressure to said pilot operated switching valve, and an additional pilot pilot valve for opening and closing said additional conduit means.

5. A hydraulic circuit according to claim 4, wherein said actuator includes a shuttle valve adapted to receive the pilot pressure from said pilot valve and the pilot pressure from said additional pilot valve and to transmit the same to said pilot operated switching valve.

6. A hydraulic circuit of a hydraulic power shovel comprising a chassis, a boom pivotally mounted on the chassis, an arm pivotally mounted on said boom, the hydraulic circuit comprising a boom cylinder means pivotally mounted between the chassis and the boom for moving the boom in an upward and downward direction, the boom cylinder means including a rod-side chamber and a bottom-side chamber, an arm cylinder means pivotally mounted between said boom and said arm for driving the arm around a connection point between the arm and the boom, a leveling cylinder means pivotally mounted between said arm and said boom for driving the boom in response to a movement of the arm, said leveling cylinder means including a rod-side chamber and a bottom-side chamber, a first conduit means for providing a communication between said rod-side chamber of said leveling cylinder means and said rod-side chamber of said boom cylinder means, a second conduit means for providing a communication between said bottom-side chamber of said leveling cylinder means and said buttom-side chamber of said boom cylinder means, a control circuit means for supplying and discharging the working medium to and from said boom cylinder means and said cylinder arm means, a switching device for closing said first conduit means and said second conduit means and, at the same time, hydraulically connecting said leveling cylinder means to a reservoir through a working medium supply and discharge means, said switching device including a control valve means disposed at an intermediate position of said first conduit means and said second conduit means, said control valve means being displaceable between a first position providing a communication between said leveling cylinder means and said boom cylinder means and a second position for providing a communication between said leveling cylinder means and said working medium supply and discharge means, an actuator means for actuating said control valve means, said control valve means includes a pilot operated switching valve normally assuming said first position and being adapted to be shifted to said second position upon receipt of pilot pressure, and wherein said actuator includes a pilot conduit for supplying a pilot pressure to said pilot operated valve and a pilot valve for opening and closing said pilot conduit.

7. A hydraulic circuit according to claim 1 wherein said working medium supply and discharge means is connected to the bottom-side chamber of said arm cylinder means.

8. A hydraulic circuit according to any one of claims 1 or 7, wherein said control valve means comprises a first control valve disposed in said first conduit means and a second control valve disposed in said second conduit means, said working medium supply and discharge means is connected to the first control valve and a rod-side chamber of the arm cylinder means and connected to said second control valve and a bottom-side chamber of the arm cylinder means.

9. A hydraulic circuit according to any one of claims 1 or 7, wherein said working medium supply and discharge means is connected to a working medium reservoir.

* * * * *